United States Patent [19]

Frank et al.

[11] 4,142,895

[45] Mar. 6, 1979

[54] PHOTOGRAPHIC COLOR DEVELOPER COMPOSITION

[75] Inventors: Karl Frank, Leverkusen; Arnfried Melzer, Cologne, both of Fed. Rep. of Germany

[73] Assignee: Agfa Gevaert Aktiengesellschaft, Leverkusen, Fed. Rep. of Germany

[21] Appl. No.: 867,048

[22] Filed: Jan. 5, 1978

[30] Foreign Application Priority Data

Jan. 12, 1977 [DE] Fed. Rep. of Germany ..... 2700938

[51] Int. Cl.[2] ..... G03C 5/30; G03C 7/00

[52] U.S. Cl. ..... 96/66.4; 96/56; 96/66 R

[58] Field of Search ..... 96/66, 66.4, 56

[56] References Cited

U.S. PATENT DOCUMENTS

| | | | |
|---|---|---|---|
| 2,936,308 | 5/1960 | Hodge | 96/66.4 |
| 3,068,100 | 12/1962 | Dersch | 96/66.4 |
| 3,201,246 | 8/1965 | Allen et al. | 96/61 M |
| 3,467,521 | 9/1969 | Frank et al. | 96/66.4 |
| 3,582,333 | 6/1971 | Yost | 96/56 |
| 3,617,282 | 10/1971 | Bard et al. | 96/22 |
| 3,619,185 | 11/1971 | Kasman | 96/66.4 |
| 3,846,129 | 11/1974 | Koh | 96/66 R |
| 3,994,730 | 11/1976 | Frank | 96/66.4 |
| 4,055,426 | 10/1977 | Ogawa | 96/66.4 |

FOREIGN PATENT DOCUMENTS

| | | | |
|---|---|---|---|
| 9537 of | 1906 | United Kingdom | 96/66.4 |

*Primary Examiner*—Mary F. Kelley

*Attorney, Agent, or Firm*—Connolly and Hutz

[57] ABSTRACT

A color developer composition is provided which has substantially improved protection against oxidation of the color developer and excellent sequestering properties characterized in that the composition comprises an α-aminocarbonyl compound, an organo-phosphonic acid and an aminocarboxylic acid.

13 Claims, No Drawings

PHOTOGRAPHIC COLOR DEVELOPER COMPOSITION

This invention relates to an aqueous alkaline colour developer composition with novel protection against oxidation.

Colour developers used for colour negative or colour reversal processes contain a relatively small quantity of sulphite ions as antioxidising agent compared with the usual black and white developers. This is because the quantity of sulphite ions normally used in black and white developers would impair or completely suppress the formation of dyes. Attempts have therefore been made to improve the resistance of colour developers to oxidation by the addition of other antioxidising agents.

One of the most commonly used antioxidising agents is hydroxylamine. However, it is known that hydroxylamine is decomposed in alkaline developer solution by the action of atmospheric oxygen. Moreover, even when oxygen is completely excluded, hydroxylamine undergoes autodecomposition in the developer solution, and this decomposition is accelerated by traces of heavy metal ions, particularly iron ions. This severely impairs the stability of colour developers which contain hydroxylamine. It has also been found that hydroxylamine not only acts as antioxidising agent but can also influence the results of development directly under certain conditions. In reversal processing, for example, it has been found that the colour densities produced by reversal development depend on the concentration of hydroxylamine.

It is clear that this does not lead to reproducible results if the developer baths are left to stand for some time, particularly if processing is carried out at elevated temperatures at which the concentration of hydroxylamine may change rapidly due to decomposition.

It is also known to add agents to photographic developers which mainly serve to prevent the formation of deposits of lime when hard water is used for preparing the developer mixture. These agents are known as sequesterring agents.

The sequestering agents used are mainly polyphosphates, e.g. sodium hexametaphosphate, and aminocarboxylic acids, e.g. ethylene diamino tetraacetic acid. If sodium hexametaphosphate is used as sequestering agent, hydroxylamine is sufficiently stable in the developer but the formation of slight lime deposits cannot be completely prevented.

Aminocarboxylic acids, on the other hand, are excellent sequestering agents for developers, including colour photographic developers. The usefulness of these compounds, for example of ethylene diaminetetraacetic acid, is, however, restricted by the fact that their presence considerably reduces the stability of colour photographic developers. This is presumably due to an accelerated decomposition of substances such as hydroxylamine which have been added to improve the resistance to oxidation.

According to German Offenlegungsschrift No. 2,015,403, the decomposition of hydroxylamine in the presence of ethylene diamine tetraacetic acid can be reduced by the addition of aromatic polyhydroxyl compounds.

The disadvantage of such a developer mixture, however, is that the aqueous solution is discoloured by complex formation of the additives with traces of heavy metals so that there is a risk of discolouration of the photographic materials.

Lastly, it is known to add a hydroxy alkane disphosphonic acid or a water soluble salt of such an acid to improve the stability of hydroxylamine in colour developers which contain hydroxylamine as anitoxidising agent and an aminocarboxylic acid as sequestering agent.

Although the last mentioned measure produces a marked improvement in the stability of hydroxylamine, this improvement is no longer sufficient due to the increasingly high standards demanded. Even minor changes in the hydroxylamine content have a marked effect on the sensitivity and gradation, particularly in the case of colour reversal development. The known measures are not sufficient to produce and use a colour developer which would operate constantly over its whole period of use.

It is an object of the present invention to provide a colour developer composition which has substantially improved protection against oxidation of the colour developer combined with efficient water softening or protection against the formation of lime deposits. In particular, it is an object of this invention to provide such a composition which has substantially improved protection against oxidation and efficient protection against the formation of lime deposits and above all ensures constant results over the whole period of use.

The invention relates to an aqueous alkaline colour developer composition containing a colour developer compound, a sequestering agent and an antioxidising agent as well as a complex forming compound which stabilises the antioxidising agent used.

The antioxidising agents according to the invention have an α-aminocarbonyl group and are represented in particular by the following general formula I or the corresponding enol formula I*a*.

I

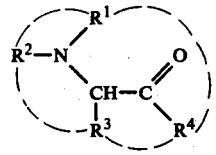

Ia

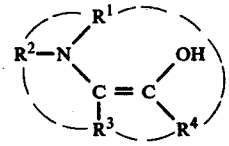

The hydrogen atom represented by the symbol "H" in formulae I and I*a* may be dissociated as a proton in the alkaline medium.

In the general formula I, $R^1$, $R^2$, $R^3$ and $R^4$ which may be the same or different represent hydrogen, hydrocarbon groups, including alkyl, in particular alkyl having up to 5 carbon atoms, cycloalkyl, e.g. cyclohexyl, or aryl, e.g. phenyl, which groups may also be substituted, e.g. with hydroxyl groups, amino groups or phenyl groups; or heterocyclic groups, in particular 5-membered or 6-membered heterocyclic groups containing N and/or O and/or S as ring members, e.g. thienyl, provided that not all four of the groups $R^1$, $R^2$, $R^3$ and $R^4$ are hydrogen.

In addition, $R^1$ and $R^2$ may together represent the atoms required to complete a heterocyclic ring, e.g. a pyrrolidine, piperidine or morpholine ring, and/or $R^2$ and $R^3$ may together represent the atoms required to complete a heterocyclic ring, e.g. a piperidine ring, and/or $R^3$ and $R^4$ may together represent the atoms required to complete a heterocyclic or carbocyclic ring, preferably a ring of this kind having 5, 6 or 7 ring members, in particular a carbocyclic ring, e.g. a cyclohexanone ring, and/or $R^4$ and $R^1$ may together represent the atoms required to complete a heterocyclic ring, e.g. a piperidone ring.

An alkyl group represented by one of the symbols $R^1$, $R^2$, $R^3$ or $R^4$ preferably has up to 5 carbon atoms, e.g. methyl, ethyl or butyl. These alkyl groups may in turn carry substituents, e.g. hydroxyl groups, amino groups or phenyl groups.

Polyhydroxyl groups, for example those found in sugar molecules, are examples of particularly suitable substituted alkyl groups.

Suitable antioxidising agents according to the present invention may correspond, for example, to the following general formula II

II

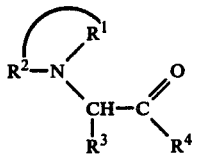

in which $R^1$ and $R^2$ together represent the atoms required to complete a heterocyclic ring, e.g. a piperidine, pyrrolidine or morpholine ring;

$R^3$ and $R^4$ which may be the same or different represent hydrogen, alkyl, e.g. methyl, ethyl or butyl, including substituted alkyl groups; aryl, e.g. phenyl; or heterocyclic groups.

Other suitable antioxidising agents according to the present invention correspond, for example, to the following general formula III

III

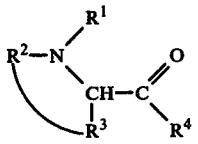

in which $R^1$ and $R^4$ which may be the same or different, represent hydrogen, alkyl such as methyl, ethyl or butyl, including substituted alkyl groups, aryl, e.g. phenyl, or heterocyclic groups;

$R^2$ and $R^3$ together represent the atoms required to complete a heterocyclic ring, e.g. a piperidine ring.

Other suitable antioxidising agents according to the present invention correspond, for example, to the following general formula IV

IV

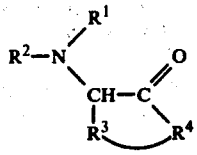

in which $R^1$ and $R^2$ which may be the same or different represent hydrogen, alkyl, e.g. methyl, ethyl or butyl, including substituted alkyl groups; aryl, e.g. phenyl, or heterocyclic groups;

$R^3$ and $R^4$ together represent the atoms required to complete heterocyclic or carbocyclic ring, particularly a carbocyclic ring, e.g. a cyclohexanone ring.

Other suitable antioxidising agents according to the present invention correspond, for example, to the following general formula V

V

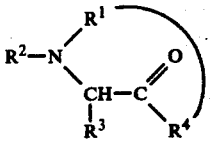

in which $R^1$ and $R^4$ together represent the atoms required to complete a heterocyclic ring, e.g. a piperidone ring, $R^2$ and $R^3$ which may be the same or different, represent hydrogen, alkyl, e.g. methyl, ethyl or butyl, including substituted alkyl groups; aryl, e.g. phenyl, or heterocyclic groups.

Compounds of the general formula I in which $R^3$ or $R^4$ represents a polyhydroxy alkyl group as found, for example, in sugar molecules, have been shown to be particularly suitable. Particularly useful compounds of this kind include, for example, D-glucosamine (Compound 1) and 1-desoxy-1-piperidino-D-fructose (Compound 2). Compounds of this kind may be in the form of cyclic semiacetals, ie. in the $\alpha$- or $\beta$-form, and may be used in this form.

The antioxidising agents according to the invention may also be added to the alkaline colour developer composition in the salt form as ammonium compounds with any anion, preferably with chloride or sulphate.

It is immaterial whether the antioxidising agent is in the carbonyl form, in the enol form or as a mixture of both forms before it is added to the developer composition.

Examples of suitable antioxidising agents according to the present invention are shown below:

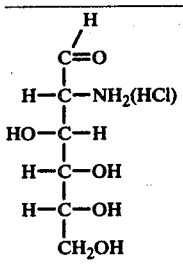

Compound 1

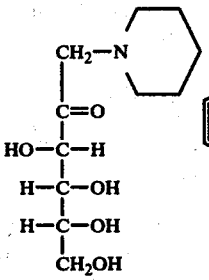

Compound 2

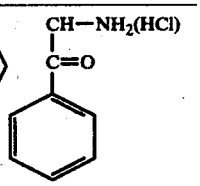

Compound 3

-continued

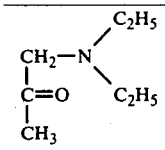

Compound 4

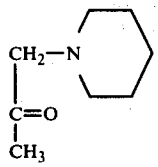

Compound 5

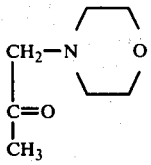

Compound 6

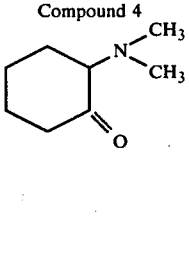

Compound 7

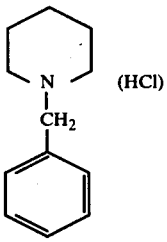

Compound 8

Compounds 1 to 8 are known compounds, some of which are available commercially.

The complex-forming compounds used according to the invention to stabilise the antioxidising agents used according to the invention are organophosphonic acids. They may be represented by the following general formula:

$$R^5R^6C(PO_3M_2)_2$$

in which $R^5$ represents a hydrogen atom, an alkyl group, preferably having from 1 to 4 carbon atoms which may be substituted, e.g. a methyl, ethyl, propyl, isopropyl, butyl, β-hydroxy ethyl or ethoxy methyl group, an aryl group which may be substituted, e.g. a phenyl group, an o-, m- or p-tolyl group or an o- or p-carboxy phenyl group or a water soluble salt of one of these groups, e.g. the sodium or potassium salt; an aralkyl group, preferably one having from 7 to 9 carbon atoms, e.g. a benzyl, β-phenethyl or o-acetamidobenzyl group; an alicyclic group preferably having 5 or 6 carbon atoms, e.g. a cyclohexyl or cyclopentyl group; or a heterocyclic group, e.g. a heterocyclic alkyl group such as a pyrrolidyl methyl, pyrrolidyl butyl, benzothiazolyl methyl or tetrahydro quinolyl methyl group or a $PO_3M_2$ group;

$R^6$ represents a hydrogen atom, a hydroxyl group or an alkyl group of the kind defined above which may be substituted and M represents a hydrogen atom, a water solubilising atom, for example an alkali metal atom such as a sodium or potassium atom, or a water solubilising group such as an ammonium, pyridinium triethanol ammonium or triethyl ammonium group.

The following are particular examples of organo phosphonic acids which may be used according to the invention:

1-hydroxy ethane-1, 1-diphosphonic acid;
ethane-1,1,1-triphosphonic acid;
1-hydroxy propane-1,1-diphosphonic acid;
1-hydroxy-2-phenylethane-1,1-diphosphonic acid.

The sequestering agents used according to the invention are preferably amino carboxylic acids. The following amino carboxylic acids are particularly preferred:

ethylenediaminetetraacetic acid;
2-hydroxypropane-1,3-diaminetetraacetic acid;
diethylenetriaminepentaacetic acid;
N-hydroxyethyl-ethylenediaminetriacetic acid;
cyclohexane-1,2-diaminetetraacetic acid.

The colour developer compounds contained in the colour developer compositions according to the invention include in particular those based on p-phenylene diamine which have a primary amino group, for example the following:

4-amino-N,N-dimethyl aniline;
4-amino-N,N-diethyl aniline;
4-amino-3-methyl-N,N-diethyl aniline;
4-amino-3-methyl-N-methyl-N-(β-methyl sulphonamido ethyl)-aniline;
4-amino-N-ethyl-N-(β-hydroxyethyl)-aniline; 4-amino-3-methyl-N-ethyl-N-(β-hydroxyethyl)-aniline;
4-amino-3-methyl-N-ethyl-N-(β-methoxyethyl)-aniline;
4-amino-3-methyl-N-ethyl-N-(β-methyl sulphonamido ethyl)-aniline, and
4-amino-N-butyl-N-(ω-sulphobutyl)-aniline.

Other suitable colour developer compounds have been described, for example, in J. Amer. Chem. Soc. 73, 3,100-3,125 (1951). The colour developer compounds may be present in the usual concentrations in the colour developer baths, e.g. in concentrations of from 0.5 to 25 g per liter.

The colour developer compositions according to the present invention also contain the usual additives in the usual quantities, such as substances which are alkaline in reaction, e.g. alkali metal hydroxides, alkali metal carbonates, alkali metal phosphates or alkali metal borates; alkali metal sulphites, alkali metal sulphates, alkali metal bromides or alkali metal iodides; silver salt solvents, e.g. alkali metal thiosulphates, ethylene diamine or alkali metal thiocyanates. The compositions may also contain viscosity increasing additives such as hydroxy alkyl cellulose or carboxy alkyl celluloses. Instead of containing alkali metal ions such as sodium or potassium ions, the above mentioned additives may also contain substituted ammonium ions.

The colour developer compositions may also contain soluble competing couplers such as citrazinic acid; development accelerators, e.g. polyethylene oxide derivatives; or, in reversal colour developer compositions, fogging agents such as boron hydride compounds or hydrazine derivatives.

The advantages of the colour developer composition according to the invention become particularly clear when the developer contains sequestering agents based on aminocarboxylic acids to prevent the formation of lime deposits, since aminocarboxylic acids normally accelerate the decomposition of β-aminocarbonyl compounds as well as of hydroxylamine. This harmful effect of aminocarboxylic acids is eliminated in the presence of the organophosphonic acids used according to the invention.

The colour developer composition according to the invention is suitable for use in all kinds of photographic colour developer baths, e.g. in colour developer baths used for the development of colour photographic negative materials or in reversal colour developer baths used for developing colour photographic reversal materials. The advantages of the colour developer composition according to the invention are particularly marked when they are used in the photographic processing of reversal materials. The advantages of the colour developer composition according to the invention are illustrated in the following examples but the invention is not restricted to the embodiments given in these examples.

EXAMPLE 1

A commercial colour photographic multi-layered reversal material containing a red-sensitive, a green-sensitive and a blue-sensitive silver halide emulsion layer and colour couplers for each partial image of the light-sensitive layers is exposed imagewise in the usual manner and developed in the following first developer I:

| Developer I | |
|---|---|
| Sodium carbonate sicc. | 30 g/l |
| ethylenediaminetetraacetic acid | 1.5 g/l |
| sodium sulphite sicc. | 40 g/l |
| 1-phenyl-3-pyrazolidone | 0.3 g/l |
| hydroquinone | 5 g/l |
| potassium bromide | 2.5 g/l |
| potassium thiocyanate | 2.0 g/l |
| potassium iodide | 0.010 g/l |
| pH adjusted to 10.0 | |

The photographic material is then treated in a short-stop bath, washed, again exposed and developed in the following second developer II

| Developer II | |
|---|---|
| ethylenediaminetretraacetic acid | 1.5 g/l |
| disodium salt of 1-hydroxyethane-1,1-diphosphonic acid | 2 g/l |
| trisodium phosphate | 50 g/l |
| sodium sulphite sicc. | 5 g/l |
| 4-amino-3-methyl-N-ethyl-N-(β-hydroxyethyl)-aniline sulphate monohydrate | 5 g/l |
| ethylene diamine | 6 ml/l |
| pH adjusted to 11.9 | |

In two other series of experiments, 0.6 g per liter and 2 g per liter of hydroxylamine sulphate respectively, are added to developer II before adjustment of the pH. In all experimental series, second development of the photographic material is followed by bleaching, fixing, washing and drying.

The sensitometric test shows that a variation in the quantity of hydroxylamine in the colour developer has a very pronounced effect on the maximum density and relative sensitivity (Table I).

Table 1:

Concentration series of hydroxylamine sulphate in developer II

| Hydroxylamine sulphate (g/l) | Maximum density | | | Relative sensitivity | | |
|---|---|---|---|---|---|---|
| | yellow | magenta | cyan | yellow | magenta | cyan |
| 0 | 2.44 | 2.77 | 3.03 | 16.6 | 14.0 | 12.6 |
| 0.6 | 2.26 | 2.74 | 2.91 | 17.1 | 14.2 | 13.8 |
| 2 | 2.24 | 2.57 | 2.83 | 18.0 | 15.6 | 15.2 |

EXAMPLE 2

A colour photographic multi-layered material according to that used in Example 1 is exposed imagewise and processed in the same way as described in Example 1 except that, in this case, no hydroxylamine sulphate is added to the developer II. Instead, varying quantities of D-glucosamine hydrochloride are added to the developer II. Sensitometric examination (Table 2) shows that the use of an α-aminocarbonyl compound (D-glucosamine) instead of hydroxylamine ensures reproducible processing results, because the α-aminocarbonyl compounds according to the invention, in contrast to hydroxylamine, act only as antioxidising agents and are not capable of harmfully affecting the processing results by side reactions.

Table 2,

Concentration series of D-glucosamine hydrochloride in developer II

| D-glucosamine hydrochloride g/l | Maximum density | | | Relative sensitivity | | |
|---|---|---|---|---|---|---|
| | yellow | magenta | cyan | yellow | magenta | cyan |
| 0 | 2.90 | 2.65 | 2.57 | 21.3 | 19.7 | 19.4 |
| 1.2 | 2.83 | 2.67 | 2.57 | 21.6 | 19.8 | 19.6 |
| 2.4 | 2.75 | 2.65 | 2.57 | 21.4 | 19.3 | 19.4 |

EXAMPLE 3

Developer II is modified in accordance with the figures shown for the first series in Table 3 and exposed to atmospheric oxidation by keeping it in slightly covered containers for various lengths of time of up to 6 weeks. The concentration of colour developer compound (4-amino-3-methyl-N-ethyl-N-(β-hyroxyethyl)-aniline sulphate monohydrate) is determined in each case after the specified period of time. Table 3 shows that the developer composition according to the invention (Developer + G) containing an α-aminocarbonyl compound, a hydroxy alkane diphosphonic acid and the ethylenediaminetetraacetic acid used in Developer II gives by far the best results.

Table 3

Storage time series
Concentration (g/l) of 4-amino-3-methyl-N-ethyl-N-(β-hydroxyethyl)-aniline sulphate monohydrate

| Weeks after preparation of sample | Developer + H (0.6 g/l) | Developer + G (1.2 g/l) | Developer + G (1.2 g/l) − P |
|---|---|---|---|
| 0 | 6.0 | 6.0 | 6.0 |
| 3 | 5.4 | 5.9 | 3.9 |
| 6 | 3.4 | 3.9 | 0 |

H = Hydroxylamine sulphate
G = D-glucosamine hydrochloride
P = Disodium salt of 1-hydroxyethane-1,1-diphosphonic acid.

We claim:

1. Photographic color developer composition for color development containing a developer compound of the p-phenylene diamine series, an antioxidizing agent comprised of an α-aminocarbonyl compound, a compound which stabilizes the antioxidizing agent and a sequestering agent, characterized in that compound which stabilizes the antioxidizing agent is a complex-forming organophosphonic acid or a water soluble salt of this acid, which inhibits decomposition of the α-aminocarbonyl compound, and the sequestering agent used is an aminocarboxylic acid or a water soluble salt of this acid and the α-aminocarbonyl compound is represented by the following general formula I or the corresponding enol form:

I

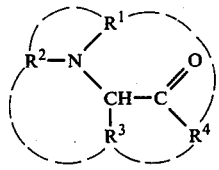

in which $R^1$, $R^2$, $R^3$ and $R^4$ which may be the same or different, represent hydrogen; hydrocarbon groups, including alkyl, cycloalkyl or aryl groups, which groups may in turn be substituted, or 5-membered or 6-membered heterocyclic groups containing N and/or O and/or S as ring members, provided that not all four of the groups $R^1$, $R^2$, $R^3$ and $R^4$ may be hydrogen;

on in which $R^1$ and $R^2$ together represent the atoms required to complete a heterocyclic ring and/or $R^2$ and $R^3$ together represent the atoms required to complete a heterocyclic ring and/or $R^3$ and $R^4$ together represent the atoms required to complete a heterocyclic or carbocyclic ring and/or $R^4$ and $R^1$ together represent the atoms required to complete a heterocyclic ring.

2. Color developer composition according to claim 1, containing an organo phosphonic acid or a water-soluble salt of the acid represented by the general formula $$R^5R^6C(PO_3M)_2$$

in which $R^5$ represents a hydrogen atom, an alkyl group preferably having from 1 to 4 carbon atoms, which may be substituted, an aryl group which may be substituted, an aralkyl group, an alicyclic group, a heterocyclic group or a $PO_3M_2$ -group;

$R^6$ represents a hydrogen atom, a hydroxyl group or an alkyl group which may be substituted;

M represents a hydrogen atom, water-solubilizing atom, or a water-solubilizing group.

3. Colour developer composition according to claim 1, characterized in that it contains, as antioxidising agent, a compound of the following formula II

II

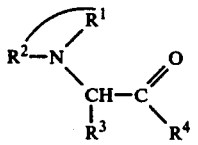

in which $R^1$ to $R^2$ together represent the atoms required to complete a heterocyclic ring and $R^3$ and $R^4$ which may be the same or different, represent hydrogen, alkyl, including substituted alkyl groups, aryl or heterocyclic groups.

4. Colour developer composition according to claim 1, characterised in that it contains, as antioxidising agent, a compound represented by the following formula III

III

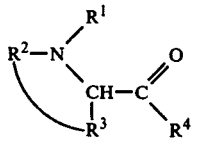

in which $R^1$ and $R^4$ which may be the same or different, represent hydrogen, alkyl including substituted alkyl groups, aryl or heterocyclic groups;

$R^2$ and $R^3$ together represent the atoms required to complete a heterocyclic ring.

5. Colour developer composition according to claim 1, characterized in that it contains, as antioxidising agent, a compound represented by the following formula IV:

IV

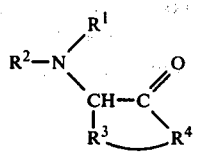

in which $R^1$ and $R^2$ which may be the same or different, represent hydrogen or alkyl, including substituted alkyl groups, aryl or heterocyclic groups;

$R^3$ and $R^4$ together represent the atoms required to complete a heterocyclic or carbocyclic ring.

6. Colour developer composition according to claim 1, characterised in that it contains, as antioxidising agent, a compound represented by the following formula V:

V

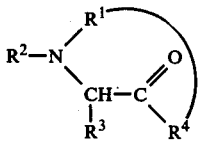

in which $R^1$ and $R^4$ together represent the atoms required to complete a heterocyclic ring, $R^2$ and $R^3$ which may be the same or different, represent hydrogen, alkyl, including substituted alkyl groups, aryl or heterocyclic groups.

7. Colour developer composition according to claim 1, characterised in that it contains at least one of the following amino carboxylic acids or a water soluble salt thereof:

ethylenediaminetetraacetic acid,
2-hydroxypropane-1,3-diaminetetraacetic acid,
diethylenetriaminepentaacetic acid,
N-hydroxyethyl-ethylenediaminetriacetic acid,
cyclohexane-1,2-diaminetetraacetic acid.

8. Colour developer composition according to claim 1, characterised in that it contains at least one of the following organophosphonic acids or a water soluble salt thereof:

1-hydroxyethane-1,1-diphosphonic acid,
ethane-1,1,1-triphosphonic acid,
1-hydroxypropane-1,1-diphosphonic acid
1-hydroxy-2-phenylethane-1,1-diphosphonic acid.

9. Colour developer composition according to claim 1, characterised in that at least one of the groups represented by $R^3$ and $R^4$ is a hydroxyl substituted alkyl group.

10. Colour developer composition according to claim 1, characterised in that it contains D-glucosamine or 1-desoxy-1-piperidino-D-fructose.

11. Colour developer composition according to claim 1, characterised in that it contains 1-hydroxyethane-1,1-diphosphonic acid or a water soluble salt of this acid.

12. Colour developer composition according to claim 1, characterised in that it contains ethylenediaminetetraacetic acid or a water soluble salt of this acid.

13. Colour developer composition according to claim 1, characterised in that it contains D-glucosamine, 1-hydroxyethane-1,1-diphosphonic acid and ethylenediaminetetraacetic acid or a water soluble salt thereof.

* * * * *

UNITED STATES PATENT AND TRADEMARK OFFICE

CERTIFICATE OF CORRECTION

PATENT NO. : 4,142,895

DATED : March 6, 1979

INVENTOR(S) : Karl Frank et al

It is certified that error appears in the above-identified patent and that said Letters Patent are hereby corrected as shown below:

Column 1, lines 42-43, correct spelling of "sequestering".

Column 2, line 6, correct spelling of "antioxidizing".

Column 4, formula of compound 3, cancel "-CH-" and insert -- - $CH_2$ --.

Column 5, formula of compound 8, the piperidine ring must be replaced by a piperidone ring.

Column 6, line 51, cancel "β-aminocarbonyl" and insert -- α-aminocarbonyl --.

Column 8, line 45, after "that" insert -- the --.

Column 9, claim 2, amend the first general formula in claim 2 to read

-- $R^5R^6C(PO_3M_2)_2$ --

Signed and Sealed this

Eighteenth Day of September 1979

[SEAL]

Attest:

LUTRELLE F. PARKER

Attesting Officer

Acting Commissioner of Patents and Trademarks